United States Patent [19]

Ostermeyer et al.

[11] Patent Number: 4,676,770

[45] Date of Patent: Jun. 30, 1987

[54] PNEUMATIC DISCHARGE APPARATUS FOR A STRIPPING CENTRIFUGE

[75] Inventors: Peter Ostermeyer, Munich; Manfred Scherer, Pfaffenhofen; Richard Widmann, Erdweg, all of Fed. Rep. of Germany

[73] Assignee: Krauss-Maffei A.G., Fed. Rep. of Germany

[21] Appl. No.: 756,315

[22] Filed: Jul. 18, 1985

[30] Foreign Application Priority Data

Jul. 18, 1984 [DE] Fed. Rep. of Germany ..... 3426526

[51] Int. Cl.[4] ..... B04B 11/08

[52] U.S. Cl. ..... 494/37; 494/59

[58] Field of Search ..... 494/37, 56, 57, 58, 494/59, 61; 210/360.1, 369, 372, 373, 374, 375

[56] References Cited

U.S. PATENT DOCUMENTS

| | | | |
|---|---|---|---|
| 1,925,121 | 9/1933 | Meer | 494/59 |
| 2,100,669 | 3/1934 | Pecker . | |
| 2,779,473 | 5/1955 | van Wezel . | |
| 3,474,905 | 10/1969 | Titus . | |
| 3,734,398 | 5/1973 | Keith | 494/58 |
| 4,063,715 | 12/1977 | Felker | 494/57 |

FOREIGN PATENT DOCUMENTS

| | | |
|---|---|---|
| 578004 | 12/1933 | Fed. Rep. of Germany . |
| 2056893 | 4/1979 | Fed. Rep. of Germany . |
| 421825 | 4/1967 | Switzerland . |

*Primary Examiner*—Robert W. Jenkins
*Attorney, Agent, or Firm*—Robert J. Koch

[57] ABSTRACT

A pneumatic discharge apparatus for a stripping centrifuge that has a stripping blade mounted on the stripper head and extending over the entire width of the drum. A filler body is further arranged in the stripper head, which affects the conveying flow through the stripper head so that the material being stripped is prevented from settling in a critical material settling area. Because the stripping blade extends over the entire width of the drum and the filler body is arranged in the stripper head, the discharge capacity of the pneumatic discharge apparatus is very high, and the sealing problems usually arising in vertical stripper centrifuges are largely eliminated.

28 Claims, 2 Drawing Figures

PNEUMATIC DISCHARGE APPARATUS FOR A STRIPPING CENTRIFUGE

BACKGROUND OF THE INVENTION

1. Field of the Invention

The invention relates to a pneumatic discharge apparatus for a stripping centrifuge.

2. Description of the Prior Art

A pneumatic discharge apparatus is shown in West German Pat. No. 20 56 893. The discharge apparatus described therein is in the form of an oscillating stripping device, which must be moved up and down in order to discharge all of the material contained in the stripping centrifuge. In addition to this axial motion, the stripping head located inside the centrifuge drum at the frontal end of the discharge line must be adjusted in the radial direction also, in order to remove as much as possible of the material to be stripped, deposited on the inside of the drum. In the course of the oscillating axial motion and the radial advance movement superposed on it, substantial sealing problems arise, caused among others, by abrasion in the bearings of the discharge apparatus. This sealing problem is of extraordinary importance particularly in pharmaceutical and chemical fields because even one drop of oil penetrating through a leak into the material to be stripped, for example, a medicine, could render the entire charge of the drug in the drum useless.

The known pneumatic discharge apparatus has a further disadvantage, namely, only a low overall discharge efficiency is obtained due to the back-and-forth motion required. Furthermore, as the material to be stripped cannot be removed completely from the drum, the remaining residual layer is being set by the constant sweep of the blade, particularly in the case of a high residual humidity. Consequently, this residual layer filters out very poorly during subsequent charges and may have to be removed manually.

Finally, in view of the time consuming oscillating motion, only a relatively low volume of the material may be discharged in unit time.

SUMMARY OF THE INVENTION

It is an object of the invention to provide a pneumatic discharge apparatus of the aforementioned generic type, whereby the problems occurring during the axial movements of the stripping blade are avoided and simultaneously an extraordinarily high discharge efficiency is obtained.

According to the invention this object is attained by a pneumatic discharge apparatus for a stripper centrifuge, in particular for a vertical stripper centrifuge, with an exhaust blower and a mobile discharge line arranged therein, and a stripper head connected with a discharge line. A stripping blade is mounted on the stripper head, and a gas inlet blower is connected to a drum so that during the discharge of the material being stripped a conveying flow traversing the stripper head is formed for the absorption and discharge of stripped-off particles. The stripping blade extends over the entire width of the drum. At least one filler body is arranged inside the stripper head. The filler body has a configuration arranged so that there is a strong tendency for the particles of the material being stripped to settle in the stripper head in a critical particle settling area. The flow conveying the particles is narrowed in the stripper head to the extent that at least in the critical stripped material settling area, the flow velocity is high enough that all particles of the material are safely removed from the stripper head.

In keeping with an essential characteristic of the invention by the arrangement of the stripping blade over the entire width of the drum, an extraordinarily high discharge efficiency is obtained. Therefore, it is possible to discharge the contents of the drum at the rated rpm capacity. Furthermore, axial movements of the discharge apparatus are avoided so that appreciable sealing problems are prevented from the onset. The risk of the penetration of abrasions and contaminant into the material to be stripped is thus reduced to a minimum. With the stripping blade arranged over the entire width of the drum, it is further possible during the stripping of the material to maintain a constant cutting velocity over the radius of the drum in the direction of the circumference of the drum by means of appropriate controls.

When the terminal position is reached near the jacket of the drum, the stripper head is retracted immediately by suitable reversing means, so that the setting of the remaining residual layer is avoided. During the filtering of subsequent charges, the residual layer thus remains filter permeable.

The pneumatic discharge apparatus according to the invention is characterized not only by the fact that it is capable of discharging large amounts of material to be discharged, but also it possesses an extraordinarily high discharge efficiency. In keeping with a fundamental concept of the invention, this high discharge efficiency is obtained as follows: because the particles of the material being stripped tend to settle in the stripper head, a filler body is arranged inside the stripper head. This affects the flow in the critical settling range of the material being stripped. As a result, the exhaust velocity at and in front of this location is increased. This causes the material particles cut by the stripping blade that drop down to be absorbed and entrained by the conveying flow. In view of the different resulting flow conditions caused by different materials being stripped, the invention allows the filler body to be replaced with one appropriate in shape and size to the different materials to be stripped. The filler body may also be adjusted to changing flow conditions in operation.

According to the invention, the side of the filler body facing the flow of the material being stripped comprises a product guide surface, channeling the flow of stripped material downward. However, in case of a suitably different material, the product flow may move down in a free fall without contacting the product guide surface. In a preferred embodiment, the product guide surface is adapted to the projection parabola of the material being stripped. For a certain type of material, it may be advantageous to provide a tear-off edge at the lower edge of the product guide surface, leading to an intense swirling together of the particles of the material with the conveying flow and thus to an increase in discharge efficiency. The product guide surface is connected at its lower end with a partial exhaust conduit surface having a semi-parabolic configuration and together with an external or outer baffle guide forming an extension of the discharge line. The flow cross section bounded by the partial exhaust conduit surface and the external or outer baffle guide is circular, so that there are no locations where the material being stripped could settle and clog the discharge conduit. A particularly advantageous optional configuration of the filler body is that not only is it possible to move the product guide surface to and from the flow of stripped material, but also the partial exhaust conduit surface may be varied in its position relative to the conveying flow. Through such variation of the partial exhaust conduit surface with respect to its position relative to the conveying flow, the exhaust velocity may be varied. For example, an increase in the exhaust velocity is indicated if heavier particles of the material being stripped could drop back from a vertical flow drying channel. The flow velocity can be increased so that even the heavier particles are entrained by the flow.

According to an advantageous embodiment of the invention, the product guide surface may be made of an elastically deformable material.

As a special device, the filler body according to the invention comprises a plurality of fluidizing nozzles arranged in the product guide surface. These fluidizing nozzles provide a gaseous cushion in case the material being stripped is thrown by high stripping velocites against the product guide surface and adheres to it, with said gaseous cushion guiding the material downward in the manner of a fluidizied layer.

It is further possible by means of the pneumatic discharge apparatus according to the invention to meter the mass flow as a function of the residual humidity. In addition, a dryer flowing the centrifuge line may operate within a preferred operating range with the use of the pneumatic discharge apparatus according to the invention. Thus, the evaporation output remains constant to the extent that the product of the multiplication of mass flow by the initial humidity of the material being stripped can be maintained constant.

BRIEF DESCRIPTION OF THE DRAWINGS

The invention shall be described below with reference to the drawings. In the drawings.

DETAILED DESCRIPTION OF THE PREFERRED EMBODIMENT

Figure 1:
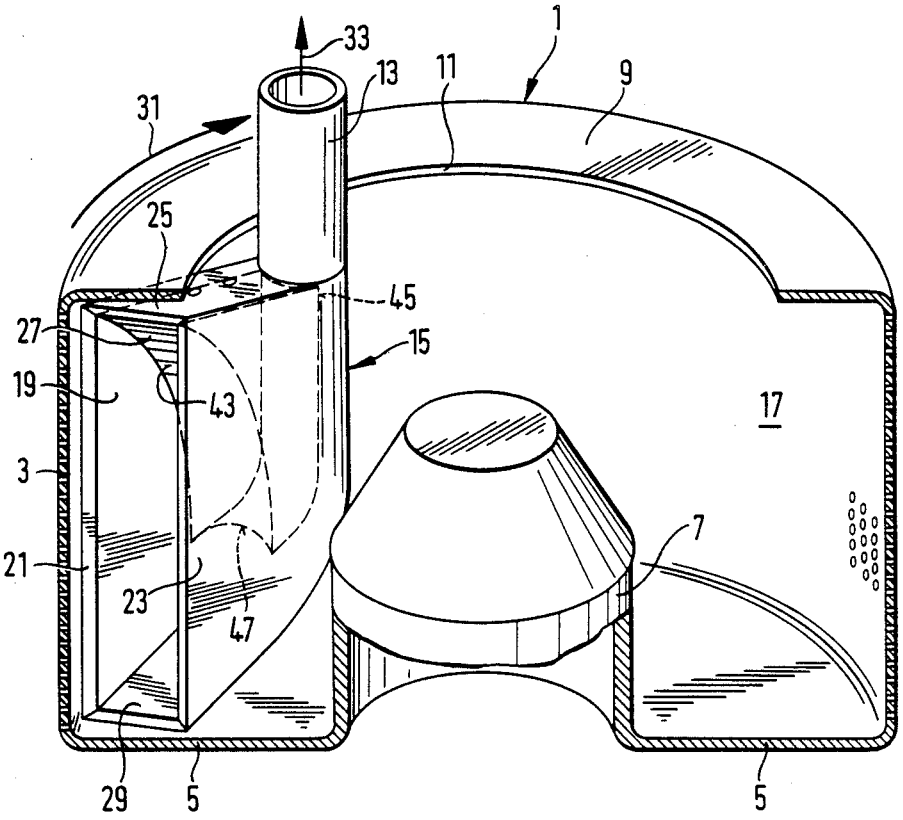
FIG. 1 shows schematically a vertical stripping centrifuge with a stripper head in drum, wherein a filler body is arranged.

FIG. 1 shows schematically a vertical section through a drum 1 of a vertical stripper contrifuge. The drum comprises a jacket 3, a bottom 5, a hub 7 and a rim 9. The inner edge of the rim 9 borders an opening 11 through which a discharge line 13 and a head 15 mounted on the discharge line 13 are introduced into the inner space 17 of the drum. The discharge drum 13 may be pivoted together with the stripper head 15, by means of a device (not shown) located outside the drum 1, in the inner space 17 of the drum in the radial direction of the drum 1.

The stripper head 15 comprises in detail a stripping surface 19 adjacent to the inner wall of the jacket, a stripping blade 21 mounted on the frontal edge of the stripping surface, a funnel surface 23 arranged opposite the stripping surface 19, an upper guide plate 25 and a filler body 27 according to the invention, mounted on the upper guide plate 25 and a filler body 27 according to the invention, mounted on; the upper guide plate and extending essentially downward in the direction of a ramp 29. FIG. 1 clearly shows that the stripper head 15 with the stripping blade mounted on its frontal side extends essentially over the entire width of the drum. In this context, attention is called to the fact that herein, as is generally customary in the construction of centrifuges, the measure determining the extent of the jacket between the rim 9 and the bottom 5 is designated the width of the drum.

As mentioned above, the stripper head 15 may be pivoted in the radial direction inside the drum, so that during the discharge process the stripping blade fastened to the frontal side of the stripper head 15 is rotated against the material being stripped, which has settled on the inside of the jacket 3 and is rotating together with the drum 1 in the direction of the arrow 31. As the result of the pivoting motion of the stripper head, the stripping blade 21 cuts into the layer of the material to be stripped. The material separated in this manner drops in the form of a drop parabola into the stripper head, is entrained by a flow of suction air, and is removed in the direction of the arrow 33.

Figure 2:
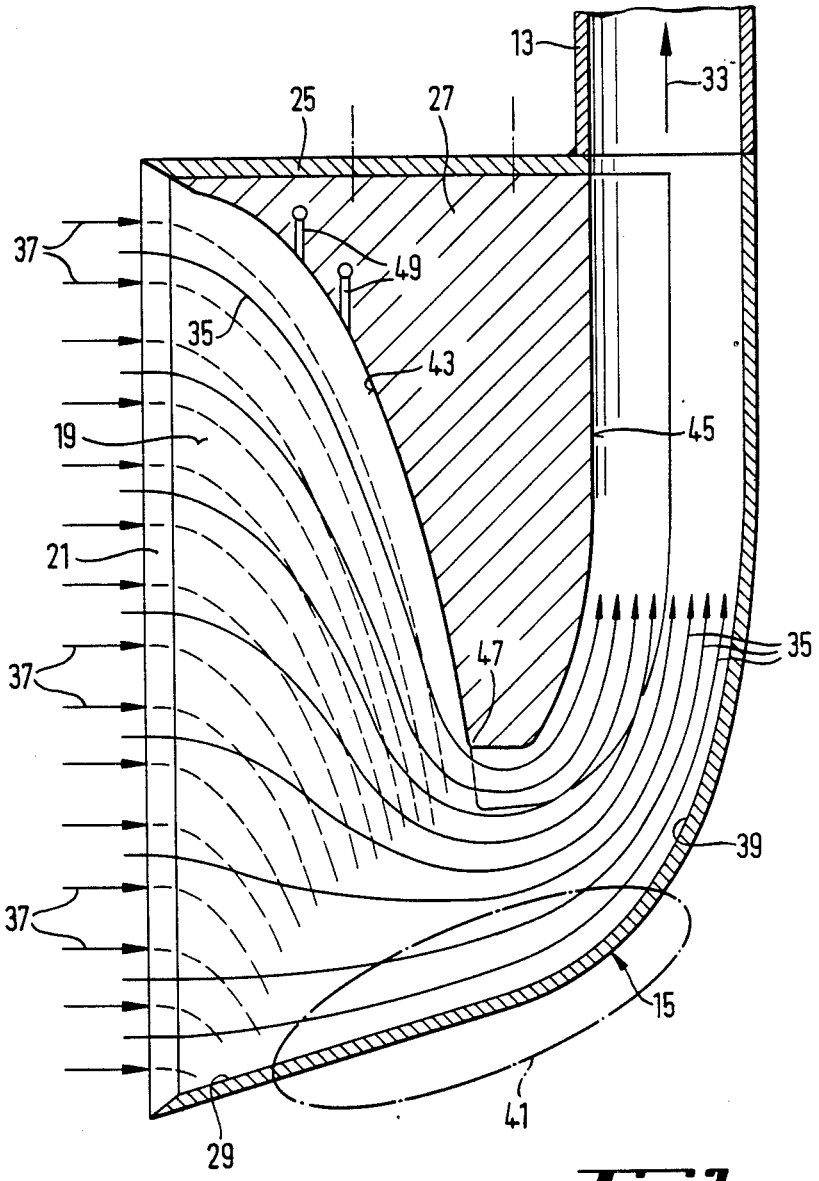
FIG. 2 shows a vertical section through the stripper head of FIG. 1 with a filler body according to the invention arranged inside the stripper head.

The filler body 27 according to the invention and its effect on the suction flow is explained in more detail in FIG. 2.

FIG. 2 shows that the stripper head 15 comprises inside a filler body 27, which is fastened to the guide wall 25, extends downward in the direction of the ramp 29 and narrows the conveying flow designated by the arrows 35. The arrows 37 indicate the manner in which the stripping blade 21 cuts into the material to be stripped and how it separates it. The material separated is being mixed into the conveying flow designated by the arrows 35 during its fall in the downward direction. As the result of the nozzle effect between the filler body 27 and the ramp 29 and/or its extension in the external baffle guide 39, said flow is strong enough so that the particles are entrained in flight and discharged in the direction of the arrow 33. By means of the specific arrangement of the filler body 27 and the resultant nozzle effect, the particles in the critical settling area of the material being stripped cannot settle during their fall in the stripper head, but are seized and entrained by the conveyor flow. The conveyor flow may consist of a drying gas especially in the case of a humid material being stripped.

The filler body 27 comprises a product guide surface 43 bordering on the flow of stripped material and a partial exhaust conduit surface 45 bordering the conveying flow in he exhaust conduit. The two surfaces are connected with each other in their bottom areas. The product guide surface 43 may be provided at its lower end with a tear-off edge 47, in order to enhance the swirling of the stripped material with the conveying flow, thereby increasing the efficiency of the entire suction process. For the case wherein the material being stripped is adhering to the product guide surface 43, a plurality of fluidizing nozzles 49 is arranged within the filler body 27, said nozzles blowing a gas between the product guide surface 43 and the material being stripped, in order to prevent the adhesion of the material. Both the product guide surface 43 and the partial exhaust conduit surface 45 may be varied to their external configuration for different products to be discharged. The product guide surface 43 may be moved to and from in the direction of the flow of material, and the partial exhaust conduit surface 45 may be moved into and from the conveying flow 35. A variation of the conveying flow 35 by the partial exhaust conduit surface 45 is indicated especially if the flow velocity in a vertical part of the discharge apparatus is to be increased. This measure is effected when it appears that the particles are agglomerating during their transport, becoming heavier in the process, and therefore dropping back into the stripper head.

In addition to the possibility of varying the impacted surfaces 43 and 45 of the filler body 27, the filler body 27 may also be exchanged and replaced by another filler body possessing external surfaces adapted to the conditions created by a new material to be stripped. It is further possible to vary the filler body with respect; to position and configuration even during operation.

What is claimed is:

1. Pneumatic discharge apparatus in a vertical stripper centrifuge for stripping and discharging material from a drum with an exhaust blower and a mobile discharge line arranged therein comprising:

a stripper head connected to the discharge line;

a stripping blade mounted on said stripper head; and wherein said stripping blade extends over the entire width of the drum;

at least one filler body is arranged inside the stripper head wherein said filler body includes means to:

(a) insure that particles of the material being stripped are directed into a critical stripped material settling area; and (b) focus the conveying flow through the critical stripped material settling area to the extent that the flow velocity is sufficient to remove all of the particles of the material being stripped from the stripper head through the discharge line.

2. Pneumatic discharge apparatus as in claim 1, wherein the stripping blade is mounted on the front edge of a lateral stripping surface of the stripper head facing the material to be stripped.

3. Pneumatic discharge apparatus as in claim 1, wherein the filler body is replaceable and fastened on an upper guide wall of the stripper head.

4. Pneumatic discharge apparatus as in claim 1, wherein said filler body extends between the lateral stripping surface and a lateral funnel surface arranged at a distance from the lateral stripping surface of the stripper head, and said filler body terminates at a distance above a lower ramp of the stripper head.

5. Pneumatic discharge apparatus as in claim 4, characterized in that the lower end of the filler body may be extended and retracted to establish a predetermined distance to the lower ramp of the stripper head.

6. Pneumatic discharge apparatus as in claim 1, wherein said filler body further comprises a product guide surface facing the material separated by the stripping blade.

7. Pneumatic discharge apparatus as in claim 6, wherein the product guide surface approximates a projection parabola with its apex at the upper end of the stripping blade and open in the downward direction.

8. Pneumatic discharge apparatus as in claim 7, wherein the filler body has a variable width.

9. Pneumatic discharge apparatus as in claim 7, wherein the product guide surface further comprises at least one fluidizing nozzle.

10. Pneumatic discharge apparatus as in claim 9, wherein the fluidizing nozzle further comprises an outlet orifice pointed essentially in the direction in which the particles of the material being stripped are flying by, in accordance with a projection parabola.

11. Pneumatic discharge apparatus as in claim 9, wherein the outlet orifice of the fluidizing nozzle is directed downward.

12. Pneumatic discharge apparatus as in claim 7, wherein the surface of the filler body is an elastically deformable material.

13. Pneumatic discharge apparatus as in claim 6, wherein the product guide surface is an inclined plane with a negative slope.

14. Pneumatic discharge apparatus as in claim 6, the product guide surface projects perpendicularly downward from the upper guide wall at a distance from the stripping blade.

15. Pneumatic discharge apparatus as in claim 6, wherein the product guide surface has a tear-off edge at its lower end.

16. Pneumatic discharge apparatus as in claim 6, wherein the filler body has a round configuration at the lower end of the product guide surface.

17. Pneumatic discharge apparatus as in claim 6, wherein the filler body has a variable width.

18. Pneumatic discharge apparatus as in claim 6, wherein the product guide surface further comprises at least one fluidizing nozzle.

19. Pneumatic discharge apparatus as in claim 18, wherein the fluidizing nozzle further comprises an outlet orifice pointed essentially in the direction in which the particles of the material being stripped are flying by, in accordance with a projection parabola.

20. Pneumatic discharge apparatus as in claim 18, wherein the outlet orifice of the fluidizing nozzle is directed downward.

21. Pneumatic discharge apparatus as in claim 18, wherein the surface of the filler body is an elastically deformable material.

22. Pneumatic discharge apparatus as in claim 6, wherein the surface of the filler body is an elastically deformable material.

23. Pneumatic discharge apparatus as in claim 1, wherein the filler body further comprises a partial exhaust conduit surface connected with the product guide surface and forms part of the discharge line.

24. Pneumatic discharge apparatus as in claim 23, wherein the partial exhaust conduit surface has the configuration of a semi-parabola with its apex at the lower end of the filler body and open in the upward direction.

25. Pneumatic discharge apparatus as in claim 24, wherein the partial exhaust conduit surface forms together with an outer baffle guide an extension of the discharge line with a circular flow cross section.

26. Pneumatic discharge apparatus as in claim 25, wherein the partial exhaust conduit surface may be moved to and from the direction of the outer baffle guide in order to vary the flow cross section.

27. A method of removing material from a stripper centrifuge drum where the material is located on a jacket in the inner space of the drum comprising the steps of:

stripping the material from the drum with a stripping head, said stripping head having a stripping surface with a stripping blade the length of which runs the entire width of the drum, an opposing funnel surface, an upper guide plate and a lower ramp connecting said stripping surface to said funnel surface, and a discharge line;

directing the material stripped to a critical stripped material settling area of said stripping head;

providing a conveying flow of gas to entrain said stripped material through said discharge line;

focusing said conveying flow with a filler body with a product guide surface, suspended from said upper guide plate and spaced from said lower ramp, through said critical stripped material settling area for increasing the velocity of said conveying flow in said critical stripped material settling area sufficiently to convey said stripped material out of said drum through said discharge line.

28. A method of removing material from a stripper centrifuge as in claim 27, wherein the step of directing is at least partially performed by said filler body and product guide surface; and further comprising providing a gaseous cushion by means of at least one fluidizing nozzle located on said product guide surface for preventing adhesion of said stripped material to said product guide surface and directing material toward said critical stripped material settling area.

* * * * *